US005244289A

United States Patent [19]

Sasaki

[11] Patent Number: 5,244,289

[45] Date of Patent: Sep. 14, 1993

[54] PRINTER HAVING DEVICE FOR ADJUSTING PRINT HAMMER STROKE

[75] Inventor: Toyonori Sasaki, Anjo, Japan

[73] Assignee: Brother Kogyo Kabushiki Kaisha, Aichi, Japan

[21] Appl. No.: 813,493

[22] Filed: Dec. 26, 1991

[30] Foreign Application Priority Data

Jan. 9, 1991 [JP] Japan ..... 3-12948

[51] Int. Cl.[5] ..... B41J 9/127

[52] U.S. Cl. ..... 400/144.2; 400/154; 400/157.3

[58] Field of Search ..... 400/58, 59, 144, 144.1, 400/144.2, 144.3, 144.4, 56, 57, 157.5, 154

[56] References Cited

U.S. PATENT DOCUMENTS

| | | | |
|---|---|---|---|
| 4,525,084 | 6/1985 | Ikeda | 400/59 |
| 4,577,192 | 12/1985 | Dollenmayer | 400/157.2 |
| 4,720,200 | 1/1988 | Gomoll et al. | 400/59 |
| 4,746,236 | 5/1988 | Shioda | 400/144.2 |
| 4,854,753 | 8/1989 | Kobata | 400/144.2 |
| 4,865,476 | 9/1989 | Kondo | 400/144.2 |
| 5,024,545 | 6/1991 | Yoshimoto et al. | 400/696 |
| 5,044,793 | 9/1991 | Wada | 400/157.3 |
| 5,066,150 | 11/1991 | Babler et al. | 400/144.2 |

FOREIGN PATENT DOCUMENTS

0289134A2 2/1988 European Pat. Off. .

*Primary Examiner*—J. Reed Fisher
*Assistant Examiner*—John S. Hilten
*Attorney, Agent, or Firm*—Oliff & Berridge

[57] ABSTRACT

A pair of main frames extend in frontward/rearward direction of a printer body. The pair of main frames are pivotally supported on a guide shaft and laterally movable therealong. The main frames are slidingly guided by a guide member through abutment members. The abutment members are supported on the main frames and are rotatably connected to adjusting plates which are also supported on the main frames. The adjusting plates are positionfixably adjustable relative to the main frame for controlling angular orientation of the main frames. Reference holes are defined in the main frames by which a print hammer is supported. The adjusting plates which support the abutment member engaging a guide member are fastened to outer surfaces of the main frames. The adjusting plates have recesses in confronting relation to the respective reference holes. When the reference holes are moved back and forth with respect to a central position in the recesses, the print hammer is moved back and forth about a guide shaft for thereby varying the stroke of the print hammer.

7 Claims, 11 Drawing Sheets

PRINTER HAVING DEVICE FOR ADJUSTING PRINT HAMMER STROKE

BACKGROUND OF THE INVENTION

The present invention relates to a printer having a device for adjusting the stroke of a print hammer up to a platen, and more particularly to the stroke adjusting device for use in a daisy-wheel-type printer.

There are well known daisy-wheel-type electronic typewriters capable of printing and erasing characters. The typewriters include a print hammer, a type wheel, a print ribbon, an erase ribbon, and drive mechanisms therefor, which are all mounted on a carriage.

In the electronic typewriters of the type, the print hammer is positionally adjustably mounted on a carriage body such that a stroke of the print hammer up to a platen can be adjusted. The print ribbon and the erase ribbon are mounted on a holder that can be shifted by a position shifting mechanism between a print position in which the print ribbon confronts the print hammer and an erase position in which the erase ribbon confronts the print hammer. The position shifting mechanism, a mechanism for driving the print hammer, and a print ribbon takeup mechanism are actuated by respective dedicated motors.

SUMMARY OF THE INVENTION

The inventor of the present invention has proposed an electronic typewriter in which the position shifting mechanism, the mechanism for driving the print hammer, the print ribbon takeup mechanism, and the erase ribbon takeup mechanism are actuated by a single motor mounted on the carriage body, so that the typewriter can be manufactured less costly and the carriage can be rendered compact. In the proposed electronic typewriter, the motor and the print hammer are mounted in positions on the carriage body, and the drive mechanisms, e.g., the position shifting mechanism and the print hammer drive mechanism, are actuated according to predetermined timing by a cam attached to the drive shaft of the motor.

In the proposed electronic typewriter, the carriage is held in predetermined positional relationship to the platen by a guide member and a guide shaft, and the print hammer is positionally nonadjustably mounted in a given position on the carriage body. Therefore, the stroke of the print hammer up to the platen cannot be adjusted.

It is an object of the present invention to provide a device for adjusting the stroke of a print hammer with respect to a platen in a printer by turning a carriage body which mounts thereon the print hammer about a guide shaft.

According to the present invention, there is provided a printer including a platen, a guide member, a guide shaft, a carriage body, and a device for adjusting a moving stroke of a print hammer. The guide member is disposed in front of and parallel to the platen. The guide shaft is disposed below the platen and the guide member and extending parallel to the platen. The carriage body is angularly movably supported on the guide shaft and is laterally movably guided by the guide shaft and the guide member along the platen. The carriage body carries a type wheel and the print hammer. The device for adjusting a moving stroke of the print hammer includes an abutment member, at least one adjusting plate, and an adjustable fixing mechanism. The abutment member has one end and another end slidably engageable with the guide member for guiding lateral movement of the carriage body along the guide member. The at least one adjusting plate is supported on the carriage body, the adjusting plate having one end pivotally connected to the one end of the abutment member, The adjustable fixing mechanism is connected between the adjusting plate and the carriage body for position-adjustably fixing the adjusting plate relative to the carriage body in a frontward/rearward direction of the printer for thereby turning the carriage body about the guide shaft to adjust a stroke of the print hammer up to the platen.

In another aspect of the invention, there is provided a printer including a platen, a guide member, a guide shaft, a carriage body, an abutment member, a pair of adjusting plates, and an adjustable fixing mechanism. The guide member is disposed in front of and parallel to the platen, the guide member having a rear end portion. The guide shaft is disposed below the platen and the guide member and behind the guide member and extending in parallel to the platen. The carriage body is angularly movably supported on the guide shaft and is guided by the guide shaft and the guide member. The carriage body is also laterally movable along the platen and carries a type wheel and a print hammer, the carriage body having an upper end portion. The abutment member is disposed on the upper end portion of the carriage body. The abutment member has a front end portion provided with an engaging portion slidably engageable with the rear end portion of the guide member for guiding the carriage body by the guide member. The pair of adjusting plates are mounted on the carriage body and are provided with support shafts extending parallel to the guide member. The abutment member has a rear end portion pivotally supported on the adjusting plates by the support shaft. The adjustable fixing mechanism is provided by which the adjusting plates are positionally adjustably fixed to the carriage body for positional adjustment in a direction perpendicular to the platen, The adjusting plates and the abutment member are positionally adjusted with respect to the carriage body in the direction perpendicular to the platen by the adjustable fixing mechanism, for thereby turning the carriage body about the guide shaft to adjust the stroke of the print hammer up to the platen.

According to the device for adjusting the stroke of the print hammer in the printer, the abutment member, the adjusting plate, and the adjustable fixing mechanism allow the carriage, even with the print hammer positionally nonadjustably mounted thereon, to turn about the guide shaft for adjusting the stroke of the print hammer up to the platen.

DETAILED DESCRIPTION OF THE PREFERRED EMBODIMENTS

A device for adjusting print hammer stroke according to one embodiment of the present invention will hereinafter be described with reference to the drawings. In the illustrated embodiment, the present invention is applied to an electronic typewriter having a single DC motor for performing a printing process, a process for winding a print ribbon in connection with the printing process, an erasing process, and a process for winding an erase ribbon in connection with the erasing process. Further, throughout the specification, the expressions "front", "rear", "above", "below", "right", "left" and "laterally" are used herein to define the various parts when the typewriter is disposed in an orientation in which it is intended to be used.

Figure 1:
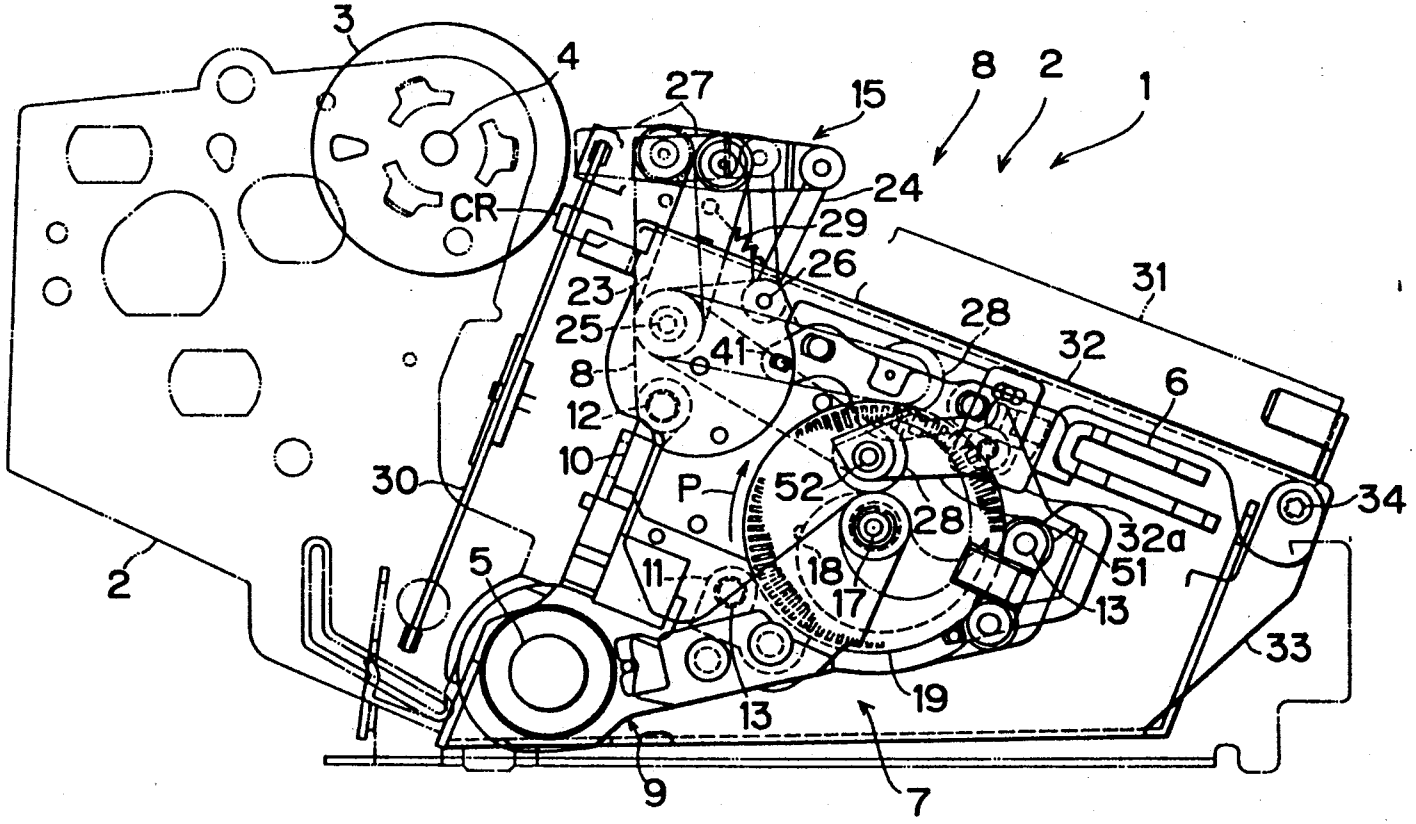
FIG. 1 is a side elevational view of an internal mechanism of an electronic typewriter.
Figure 2:
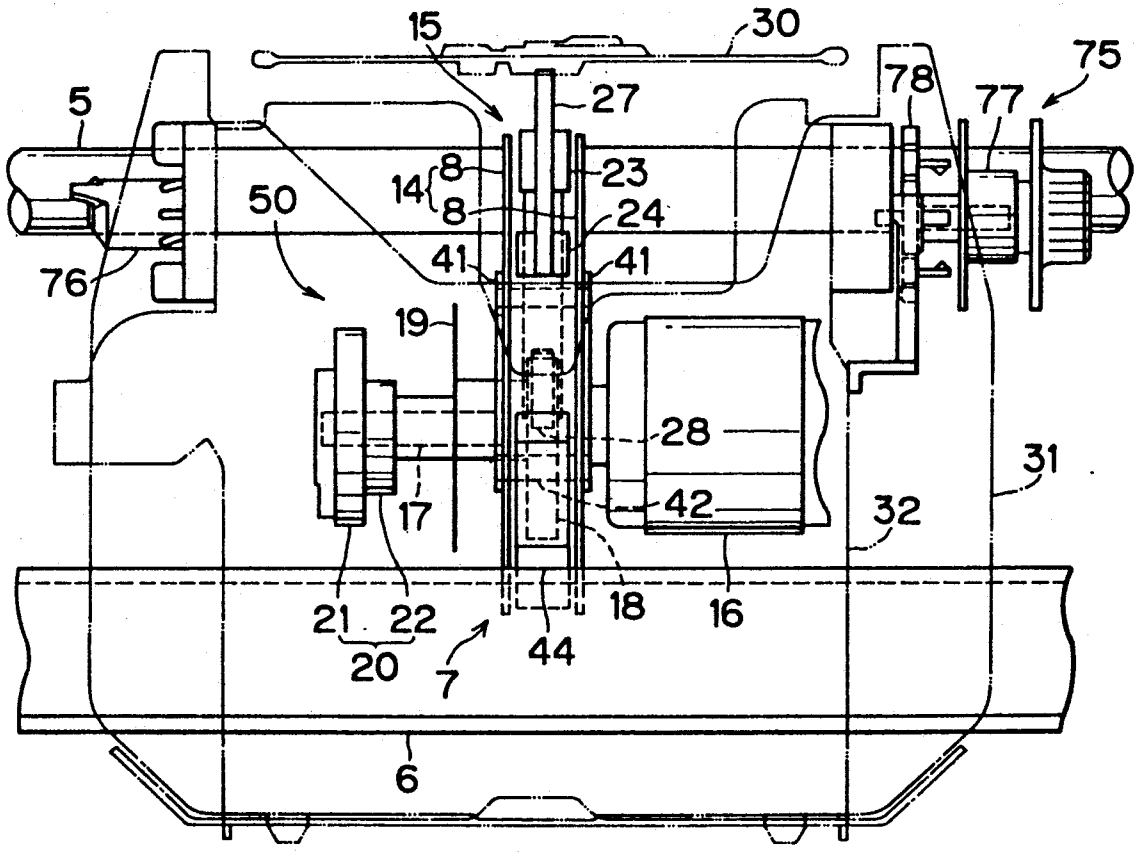
FIG. 2 is a view as viewed in the direction indicated by the arrow 2 in FIG. 1.

As shown in FIGS. 1 and 2, a typewriter 1 has a casing including side wall panels (machine frames) 2 positioned at respective lefthand and righthand ends thereof. A platen 3 is disposed between the side wall panels 2 and rotatably supported thereby in the vicinity of opposite ends of a platen shaft 4. The platen 3 can be rotated about its own axis by a platen drive motor (not shown) and a platen drive mechanism (not shown) through a driven gear (not shown) fixed to the lefthand end of the platen shaft 4.

Between the side wall panels 2, there are disposed a guide shaft 5 and a guide member 6 of a substantially Ushape as viewed in side elevation. The guide shaft 5 and the guide member 6 extend in a direction parallel to the platen 3. A carriage 7 is supported on the guide shaft 5 and the guide member 6 for lateral movement therealong. Now, the carriage 7 will be described below with reference to FIGS. 1 through 5.

A pair of lefthand and righthand main frames 8, which are spaced laterally from each other and each in the form of a substantially rectangular plate, are positioned between the guide shaft 5 and the guide member 6. The main frames 8 extend in a direction normal to the guide shaft 5 and the guide member 6. A support member 9 is laterally movably and rotatably supported on the guide shaft 5 for supporting the main frames 8. The support member 9 has first and second support arms 10 and 11. The main frames 8 are supported on upper ends of the first and the second support arms 10, 11 which serve as spacers positioned between the main frames 8 and 8. More specifically, the main frames 8 are fixed by pins 12, 13 to the outer surfaces of the upper ends of the first and second support arms 10, 11. The main frames 8 jointly serve as a carriage body 14.

A print mechanism 15 will now be described below. An auxiliary frame 33 is laterally movably supported on the guide shaft 5 for movement therealong. A print ribbon is stored in a ribbon cassette 31 that is placed on a holder member 32 vertically swingably supported by a support shaft 34 on the auxiliary frame 33. The holder member 32 has a printing position and an erasing position in accordance with its pivotal motion about an axis of the support shaft 34. A DC motor 16 is nonrotatably supported on the righthand main frame 8. The DC motor 16 has a drive shaft 17 extending to the left through the main frames 8. To the drive shaft 17, there are secured, successively from the motor 16, a print cam 18, an encoder disk 19, a ribbon supply cam 22 and a lifter cam 21. The print cam 18 is positioned between the main frames 8 and has substantially whirl-shape in side elevation for moving a print hammer 27(described later) toward and away from the platen 3. The encoder disk 19 has a plurality of slits defined in an outer periphery thereof. The ribbon supply cam 22 also has a whirl shape and is adapted for supplying the print ribbon stepwise in increments. The lifter cam 21 is adapted for lifting the holder member 32 into the erasing position. The print cam 18, the ribbon supply cam 22, and the lifter cam 21 jointly serve as a cam assembly 20, and the ribbon supply cam 22 and the lifter cam 21 are provided integrally with each other as a cam body. In FIG. 1, a printing start position for the print cam 18 is shown by dotted lines, and an origin setting position for the print cam 18 is shown by two-dot-and-dash lines.

A turn lever 23 is provided which has substantially L-shape as viewed in side elevation. A link 24 is also provided on the main frames 8. A central portion of the turn lever 23 and a lower end portion of the link 24 are angularly movably supported on upper rear end portions of the main frames 8 by pins 25, 26, respectively. The print hammer 27 that extends perpendicularly to the platen 3 and confronts the platen 3 is angularly movably supported at its rear end on the upper end of the link 24, and at its center on the upper end of the turn lever 23. A cam follower 28 is rotatably mounted on the front end of the turn lever 23. A tension spring 29 is connected between an upper end portion of the turn lever 23 and a lower end portion of the link 24 for normally urging the cam follower 28 to be held against the cam surface of the print cam 18. A daisy wheel 30 is provided rotatably by a wheel drive motor (not shown) and a wheel drive mechanism (not shown). The carriage 7 is reciprocally movable along the platen 3 by a carriage drive motor(not shown) and a drive mechanism (not shown) through a drive wire (not shown).

The whirl-shaped print cam 18 is adapted to move the print hammer at high speed at an initial moving process, and is adapted to decelerate the moving speed of the print hammer immediately before the hammer impingement onto the platen 3. To this effect, in FIG. 4, the print cam 18 has largely increasing radius from a zone 18-1 to 18-2 so as to increase moving speed of the print hammer 27 toward the platen 3, and has a moderately increasing radius from a zone 18-2 to 18-3 so as to decelerate the moving speed immediately before the impingement of the hammer onto the platen. Thus, soft-touch hammer impression results. Further, with this arrangement, disengagement of the cam follower 28 from the print cam 18 can be prevented due to inertial force which may be provided during the rolling contact of the cam follower 28 at the high speed zone 18-1 to 18-2.

When the motor 16 is energized to rotate the drive shaft 17 a predetermined angle in the printing direction indicated by the arrow P in FIG. 1, the cam follower 28 is lifted along the cam surface of the print cam 18. The turn lever 23 is turned in a counterclockwise direction about the shaft 25, forcing the print hammer 27 to press a type character of the daisy wheel 30 and the print ribbon against the platen 3.

A pair of adjusting plates 41 are adjustably fixed to the main frames 8 by an adjustable fixing mechanism 40 for adjusting the stroke of the print hammer 27 up to the platen 3. The adjustable fixing mechanism 40 will be described below with reference to FIGS. 1, 2, and 4.

Figure 4:
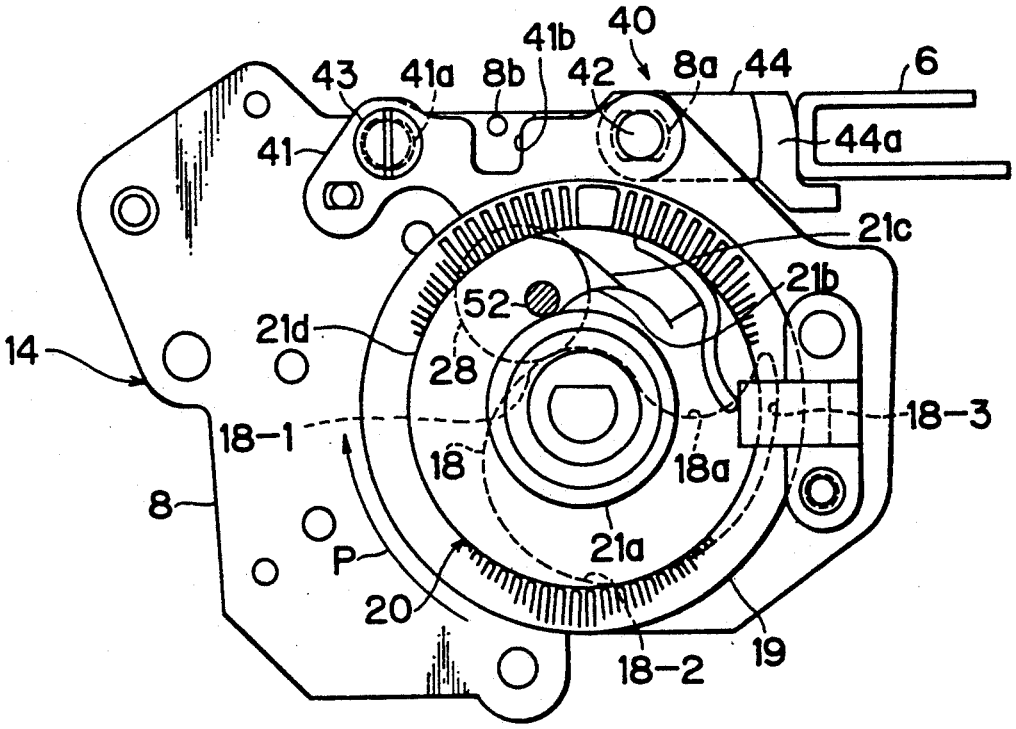
FIG. 4 is a side elevational view of a main frame and an adjusting plate.

Each of the main frames 8 is formed with oblong holes 8*a* as best shown in FIG. 4 at an upper front portion thereof, and is formed with a reference hole 8*b* at the upper intermediate portion thereof. The oblong hole 8*a* extends in frontward/rearward direction of the printer. The adjusting plates 41 extend perpendicularly to the guide member 6, and are positioned on the outer sides of upper end portions of the main frames 8, respectively. A support shaft 42 is fixed to front ends of the adjusting plates 41, and extends through the oblong holes 8*a* of the respective main frames 8. The adjusting plates 41 have oblong holes 41*a* defined respectively in rear ends thereof. The oblong hole 41*a* extends in frontward/rearward direction of the printer. The adjusting plates 41 are also formed with rectangular recesses 41*b* at their upper end portions. The main frames 8 and the adjusting plates 41 are joined to each other by a screw 43 extending through the oblong holes 41*a*. An abutment member 44 is angularly movably supported at its rear end on the support shaft 42, and has an engaging member 44*a* held in slidable engagement with a rear end of the guide member 6.

Figure 6:
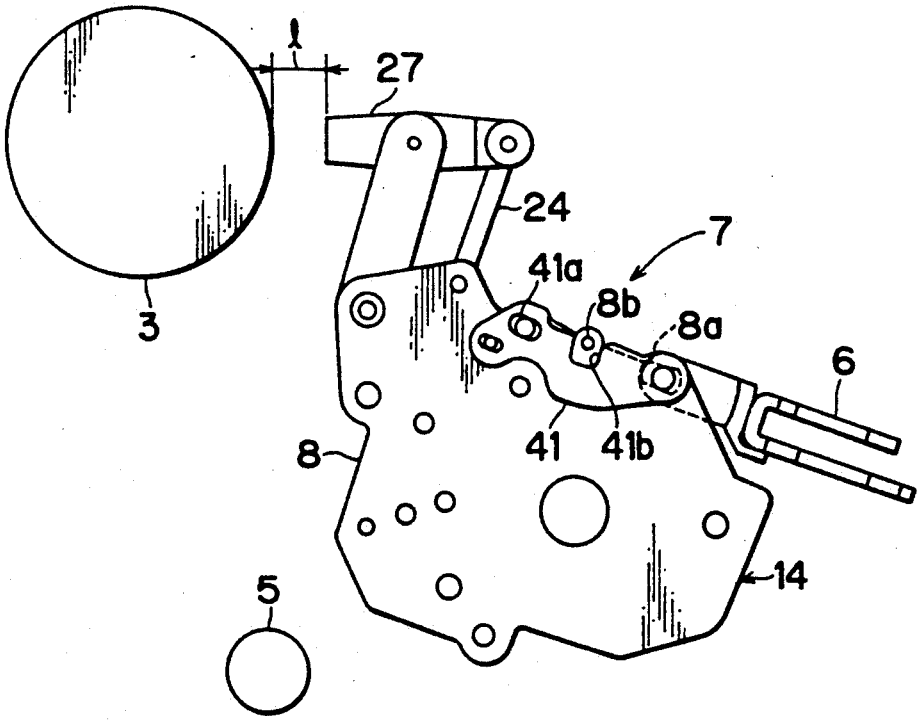
FIG. 6 is a side elevational view of a platen and a carriage with a print hammer stroke set to a reference stroke.

The main frames 8 are movable in frontward/rearward directions by a length of the oblong holes 8*a*, 41*a*. The main frames 8 and the adjusting plates 41 are fastened by the screw 43 such that the reference holes 8*b* defined in the main frames 8 are positioned centrally in the rectangular recesses 41*b* of the adjusting plates 41. At this time, the reference holes 8*b* are in a reference position. In the reference position, the stroke of the print hammer 27 up to the platen 3 provides a predetermined print hammer stroke e, as shown in FIG. 6.

Figure 7:
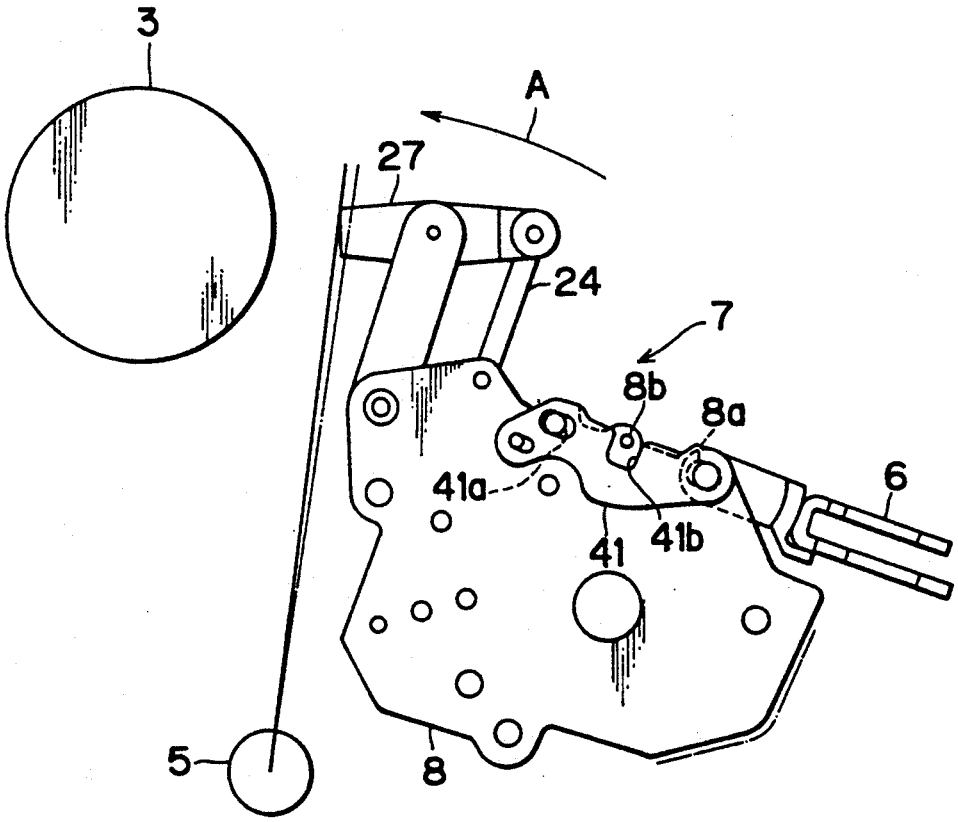
FIG. 7 is a side elevational view of a platen and a carriage with a print hammer stroke set to shorter than a reference stroke.

To shorten the print hammer stroke e , the screw 43 is loosened and then the reference holes 8*b* are displaced rearwardly from the reference position in the recesses 41*b*, as shown in FIG. 7. At this time, since the adjusting plates 41 are always held in a predetermined positional relationship to the guide member 6 by the support shaft 42 and the abutment member 44, the carriage body 14 is moved rearwardly, i.e., the carriage body 14 is angularly moved in the direction indicated by the arrow A about the guide shaft 5. The print hammer 27 integrally coupled to the carriage body 14 is moved toward the platen 3, making the print hammer stroke smaller than the print hammer stroke e in the reference position. Conversely, when the reference holes 8*b* are moved forwardly from the reference position, the carriage body 14 is moved forwardly, i.e., the carriage body 14 is angularly moved in the direction opposite to the direction A (FIG. 7) about the guide shaft 5. The print hammer 27 is now moved away from the platen 3, making the print hammer stroke larger than the print hammer stroke e in the reference position.

An erase mechanism 50 lifts the holder member 32 from a printing position to an erasing position to bring an erase ribbon in confronting relation to the print hammer 27 for erasing a printed character or printed characters. The erase mechanism 50 will now be described below with reference to FIGS. 1 through 5.

Figure 5:
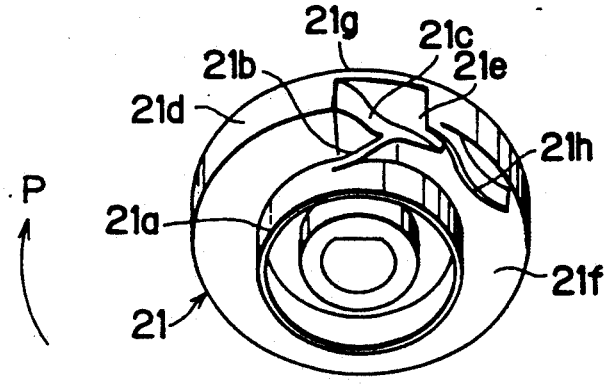
FIG. 5 is a perspective view of a lifter cam.

The lifter cam 21 and the ribbon supply cam 22 are provided integrally with each other as a cam body, as described above. As shown in FIG. 5, the lifter cam 21, which is positioned on the lefthand side of the cam body, has a reference cam surface 21*a*, a first slant cam surface 21*b*, a second slant cam surface 21*c* and an outer circumferential surface 21*d*. The reference cam surface 21*a* has a constant radius from the center of the cam 21. The first slant cam surface 21*b* extends continuously radially outwardly from the reference cam surface 21*a*. The second slant cam surface 21*c* is joined to an intermediate portion of the first slant cam surface 21*b* and extends radially outwardly to the outer circumferential surface 21*d*. The outer circumferential surface 21*d* includes a thin portion 21*g* contiguous therewith. A guide wall 21*e* is provided adjacent to the second slant cam surface 21*c*. The thickness of the guide wall 21*e* is progressively thinner in a direction opposite the direction P, so that the second slant cam surface 21*c* is progressively wider in the direction opposite the direction P. Further, a guide rib 21*h* is provided at a lefthand surface 21*f*. The guide rib 21*h* is adapted for preventing a follower pin 52 (described later) from being separated from the cam surfaces when the lifter cam 21 is rotated in the direction P and when the follower pin 52 is running on the second slant cam surface 21*c*. That is, the follower pin 52 may be separated from the second slant cam surface 21*c* because of inertial force. However, the follower pin 52 abuts the guide rib 21*h*, so that the follower pin 52 can be positioned on the reference cam surface 21*a* when the lifter cam 21 is rotated in the direction P.

A support member 51 is provided whose upper end is fixed to a lefthand side wall 32*a* of the holder member 32. The follower pin 52 is held against the lefthand side of the lifter cam 21. The follower pin 52 is laterally movably supported on a lower end of the support member 51, and is resiliently urged to the right at all times by a coil spring 53. When the printer starts to print desired characters, the follower pin 52 has its tip end held against, from above, the reference cam surface 21*a*, as shown in FIG. 4, to hold the holder member 32 in a printing position (reference angular position) shown in FIG. 1. At this time, the tip end of the follower pin 52 is also held against the end surface 21*f* from the left. The angular movement of the holder member 32 is determined by vertical movement of the follower pin 52. The positional relationship between the print cam 18, the lifter cam 21, and the follower pin 52 in the printing start position is shown in FIG. 4.

When the motor 16 is energized to rotate the drive shaft 17 by a predetermined angle from a phase angle at the printing start position shown in FIG. 4 in the direction (hereinafter referred to as "nonprinting direction")

opposite to the printing direction P, the follower pin 52 is displaced upwardly by the first slant cam surface 21*b*, and reaches the second slant cam surface 21*c*. The holder member 32 is angularly moved upwardly by a distance depending on the distance by which the follower pin 52 is moved upwardly. When the drive shaft 17 of the motor 16 is thereafter rotated in the printing direction P, the follower pin 52 moves along the second slant cam surface 21*c* onto the outer circumferential surface 21*d*. Thus, the holder member 32 is angularly moved further upwardly into an erasing position.

Figure 3:
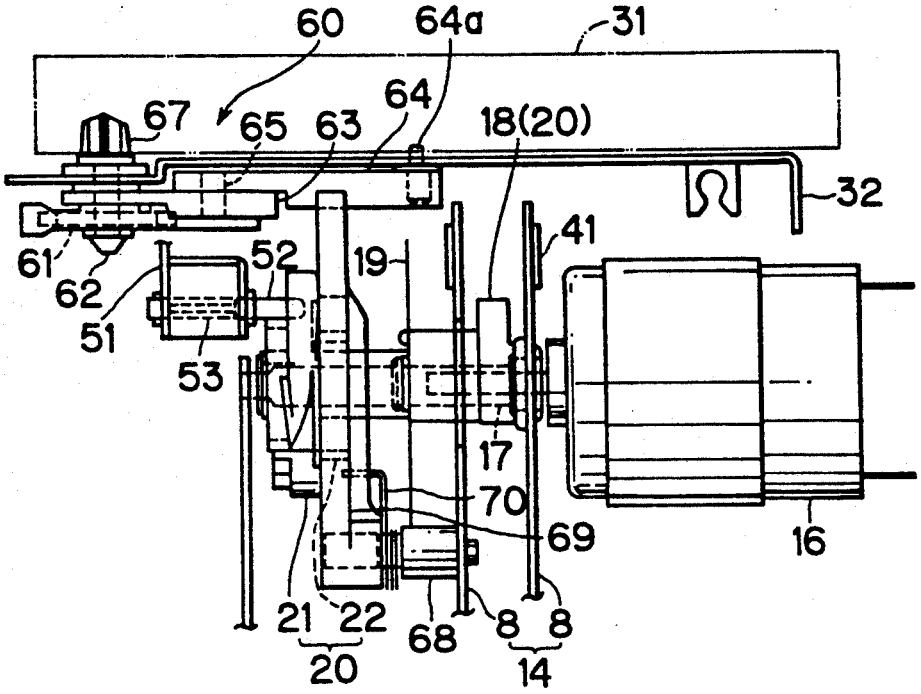
FIG. 3 is a fragmentary front elevational view of the internal mechanism of the electronic typewriter.
Figure 8:
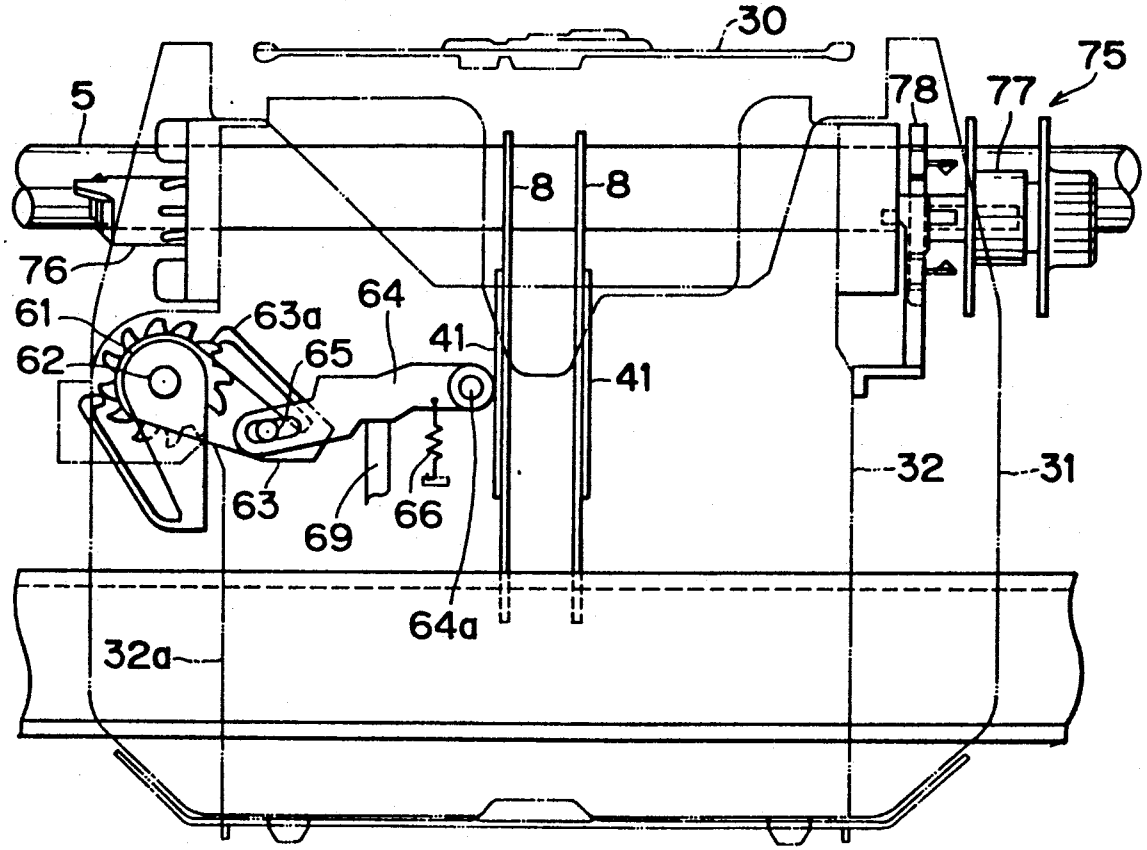
FIG. 8 is view as viewed in the direction indicated by the arrow 8 in FIG. 1.

A print ribbon takeup mechanism 60 for winding a length of the print ribbon on a takeup spool in each printing process will be described below with reference to FIGS. 3, 8, and 9.

A ratchet 61 having a plurality of teeth is rotatably supported on a lower lefthand end portion of the holder member 32 by a pin 62. A third swing member 63 is rotatably supported on the pin 62 and has a feed pawl 63*a*. The third swing member 63 is connected by a coupling pin 65 to a second swing member 64 that is angularly movably mounted on the holder member 32 at a pivot shaft 64*a*. The second swing member 64 is normally urged to turn counterclockwise in FIG. 8 under the resiliency of a tension spring 66. A takeup spool 67 is fixed to the pin 62. A first swing member 69 has a lower end angularly movably supported on a pivot pin 68 fixed to the lefthand main frame 8 in positional alignment with the ribbon supply cam 22 as best shown in FIG. 9. The first swing member 69 has an upper end held against the second swing member 64 near a proximal end thereof from the front side thereof. The first swing member 69 has a substantially circular hole 69*a* defined therein with the ribbon supply cam 22 positioned in the circular hole 69*a*. A projection 69*b* extends inwardly from the circular hole 69*a*, so that the projection 69*b* can abut the profile of the ribbon supply cam 22. The first swing member 69 is normally urged to turn clockwise (FIG. 9) under the resiliency of a torsion spring 70 coiled around the pivot pin 68 so that the projection 69*b* of the first swing member 69 abuts against a portion of the ribbon supply cam 22 at all times.

Figure 9:
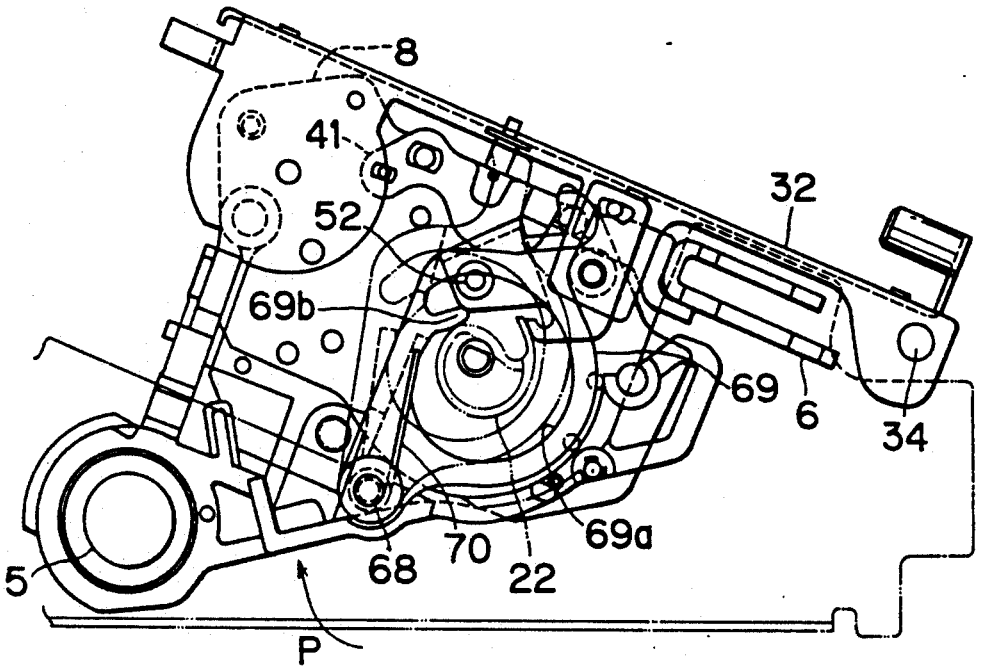
FIG. 9 is a fragmentary side elevational view of the internal mechanism.

When the motor 16 is energized to rotate the drive shaft 17 in the printing direction P, the ribbon supply cam 22 is rotated so that the first swing member 69 is turned about the pivot pin 68 in the counterclockwise direction in FIG. 9 in accordance with the cam profile of the ribbon supply cam 22 through the projection 69*b*. The second swing member 64 is turned in the clockwise direction in FIG. 8 because of the abutment with the upper portion of the first swing member 69. Thus, the third swing member 63 is turned in the counterclockwise direction in FIG. 8, causing the feed pawl 63*a* to turn the racket 61 by an angular interval corresponding to one tooth of the racket 61. Immediately prior to the printing operation, the print ribbon is fed stepwise in a predetermined increment by the rotation of the takeup spool 67.

An erase ribbon takeup mechanism 75 for winding a length of the erase ribbon on a takeup spool in an erasing process will be described below with reference to FIGS. 2, 8, 10, and 13 through 16. In FIGS. 13 through 16, the lifter cam 21 is indicated by the solid lines, the ribbon supply cam 22 by the dot-and-dash lines, and the first swing member 69 by the two-dot-and-dash lines.

An erase ribbon supply spool 76 is rotatably mounted on the side wall 32*a* of the holder member 32 at its rear end, and an erase ribbon takeup spool 77 is rotatably mounted on a righthand side wall of the holder member 32 at its rear end. The takeup spool 77 is connected to a ratchet 78 having a plurality of teeth. A feed pawl 79 for turning the ratchet 78 one tooth at a time is vertically mounted on the auxiliary frame 33 behind the ratchet 78.

It is assumed that the phase angle of the motor 16 at the printing start position is 0°. As shown in FIGS. 12 through 16, when the motor 16 is energized to turn the drive shaft 17 from the phase angle of 0° (see FIG. 13) by about 55° in the nonprinting direction, i.e., by a phase angle of −55°, the follower pin 52 is lifted along the first slant surface 21*b* from about a phase angle of −5° to about a phase angle of −43°, and thereafter is positioned on the second slant cam surface 21*c* (see FIG. 14). At this time, the follower pin 52 is lifted about 2 mm from the reference cam surface 21*a*. It should be noted that the ratchet 78 is urged in a counterclockwise direction in FIG. 15 because of the tension of the erase ribbon.

Figure 15:
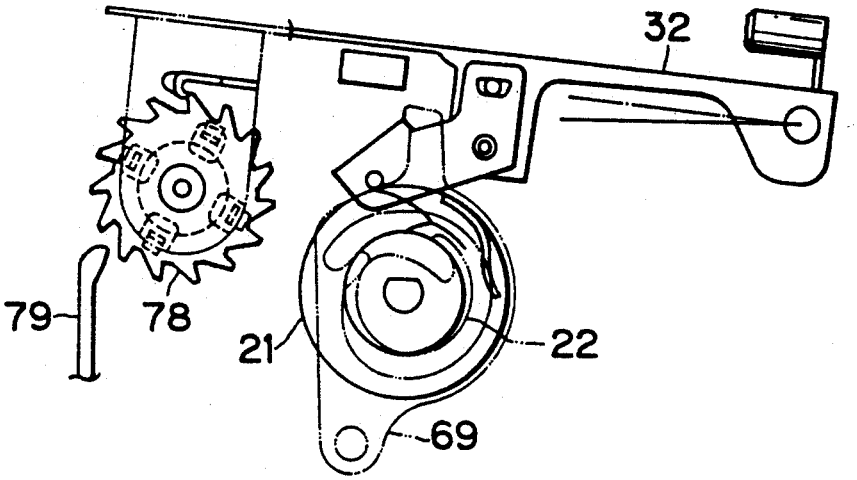
FIG. 15 is a view similar to FIG. 13, showing the parts positioned when a holder member is in an erasing position.
Figure 16:
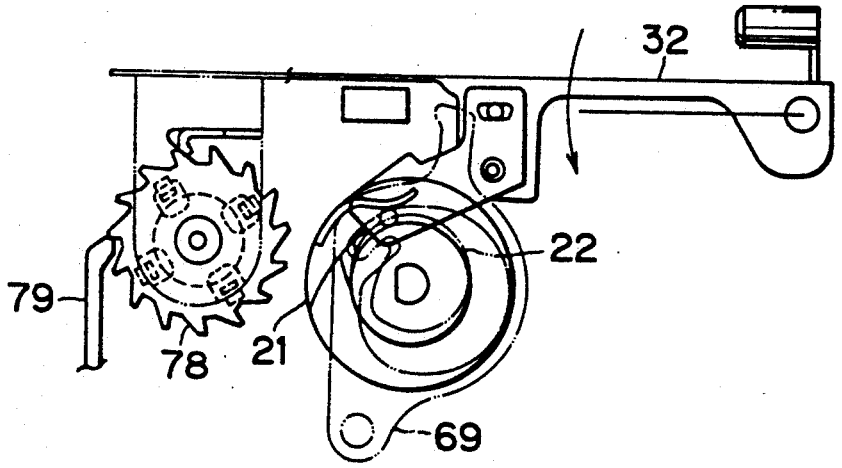
FIG. 16 is a view similar to FIG. 13, showing the parts positioned when the origin for a cam assembly is set.

When the drive shaft 17 of the motor 16 is rotated back from the phase angle of −55° to the phase angle of 0° in the printing direction P, the follower pin 52 moves on the second slant cam surface 21*c* until it reaches the outer circumferential surface 21*d* (see FIG. 15). At this time, the holder member 32 is in the erasing position in which the erase ribbon confronts the print hammer 27. On the above movement, the feed pawl 79 starts disengaging from the tooth of the ratchet 78 in a position P1, and the feed pawl 79 fully disengages from the tooth of the ratchet 78 in a position P2. The feed pawl 79 is now engageable with a lower tooth of the ratchet 78. At this time, the follower pin 52 is lifted about 5.7 mm from the reference cam surface 21*a*.

The drive shaft 17 is rotated from the phase angle of 0° in the printing direction P to effect an erasing process. Thereafter, when the drive shaft 17 is rotated through a phase angle of −90° in the nonprinting direction, the follower pin 52 moves back from the outer circumferential surface 21*d* along the second slant cam surface 21*c* to the reference cam surface 21*a* (see FIG. 16). On this movement, the feed pawl 79 starts engaging the lower tooth of the ratchet 78 in a position P3, fully engages the lower tooth in a position P4, and turns the lower tooth upwardly in response to downward swinging movement of the holder member 32 in a position P5. Accordingly, the ratchet 78 is rotated in a clockwise direction in FIG. 16 against the urging force from the erase ribbon, and thus, the erase ribbon is now fed stepwise in a predetermined increment by the takeup spool 77. In the position P5, the follower pin 52 is lowered to the reference cam surface 21*a* by the guide surface 21*e*, lowering the holder member 32 to the printing position. Subsequently, the drive shaft 17 rotates to the phase angle of 0° in the printing direction P during which time the follower pin 52 only moves along the reference cam surface 21*a* through a position P6.

Figure 12:
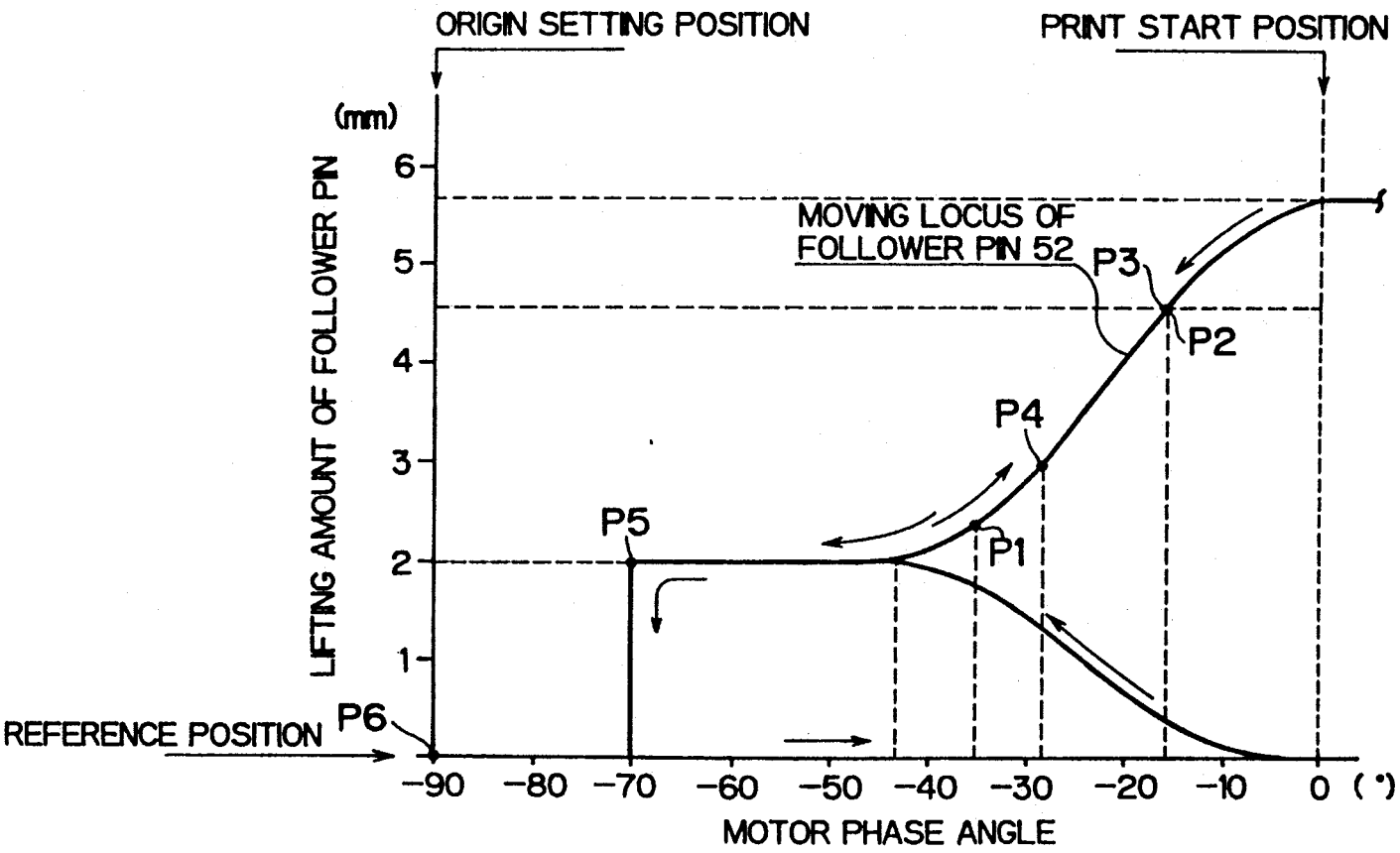
FIG. 12 is a diagram showing a curve along which a follower pin is movable.
Figure 13:
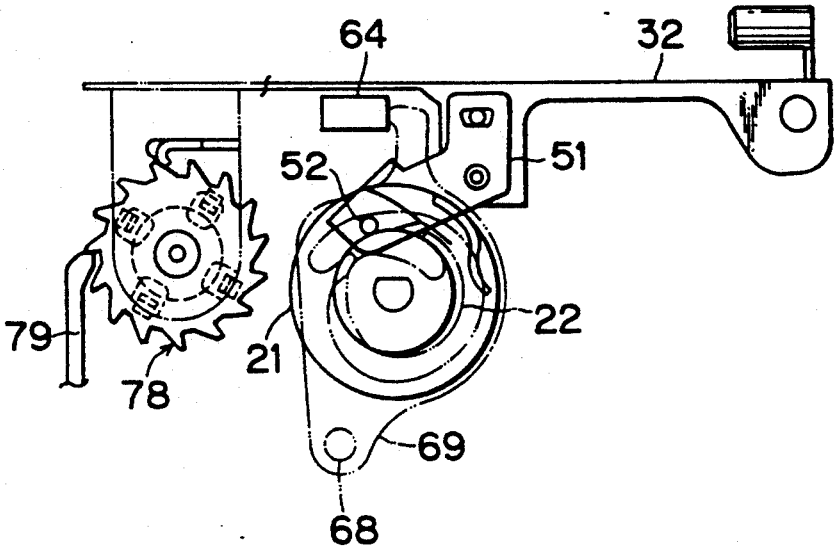
FIG. 13 is a fragmentary side elevational view of the internal mechanism in a printing start position.
Figure 14:
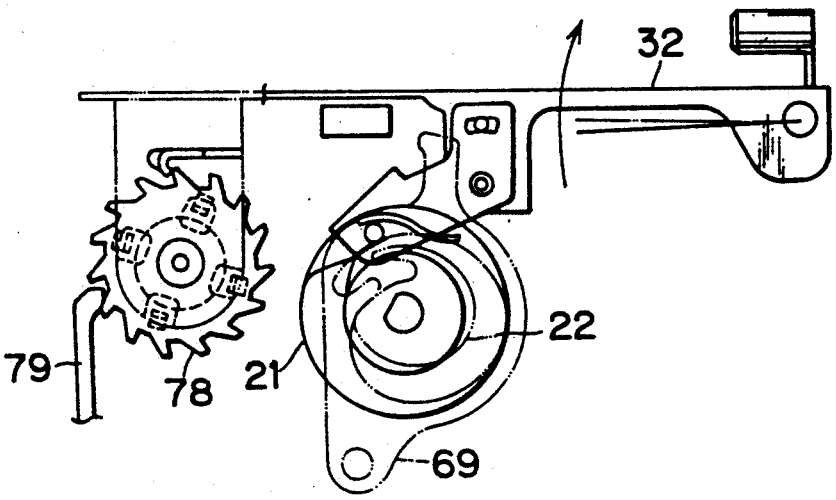
FIG. 14 is a view similar to FIG. 13, showing the parts positioned when the follower pin moves onto a second slant cam surface.

Setting the origin for the cam assembly 20 at the time the power supply of the printer will be described below with reference to FIGS. 4 and 12.

In response to a command for setting the origin, the motor 16 is energized to rotate the drive shaft 17 in the nonprinting direction. When the phase angle of the drive shaft 17 is at −90°, a concave surface 18*a* of the print cam 18 and the cam follower 28 engage each other. At this time, the follower pin 52 moves on the first slant cam surface 21*b* up to a height of about 2 mm.

When the follower pin 52 moves past the position P5, it is lowered again to the reference cam surface 21*a* by the guide surface 21*e*. Since the follower pin 52 does not ascend up to the position P2, but the holder member 32 only swings to a position lower than the erasing position, the teeth of the ratchet 78 are not turned by the feed pawl 79.

Figure 10:
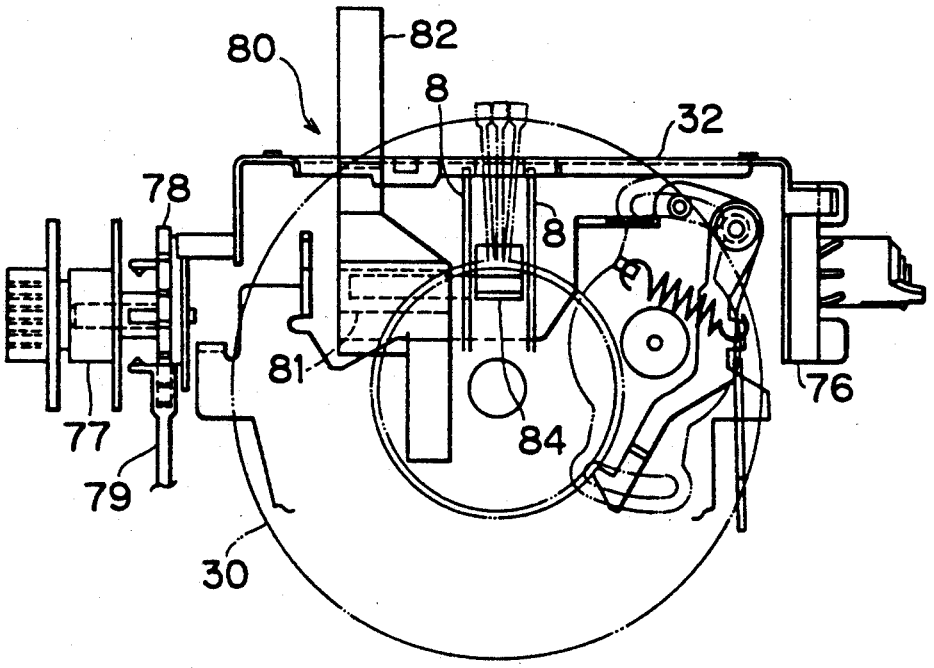
FIG. 10 is a fragmentary rear elevational view of the internal mechanism.
Figure 11:
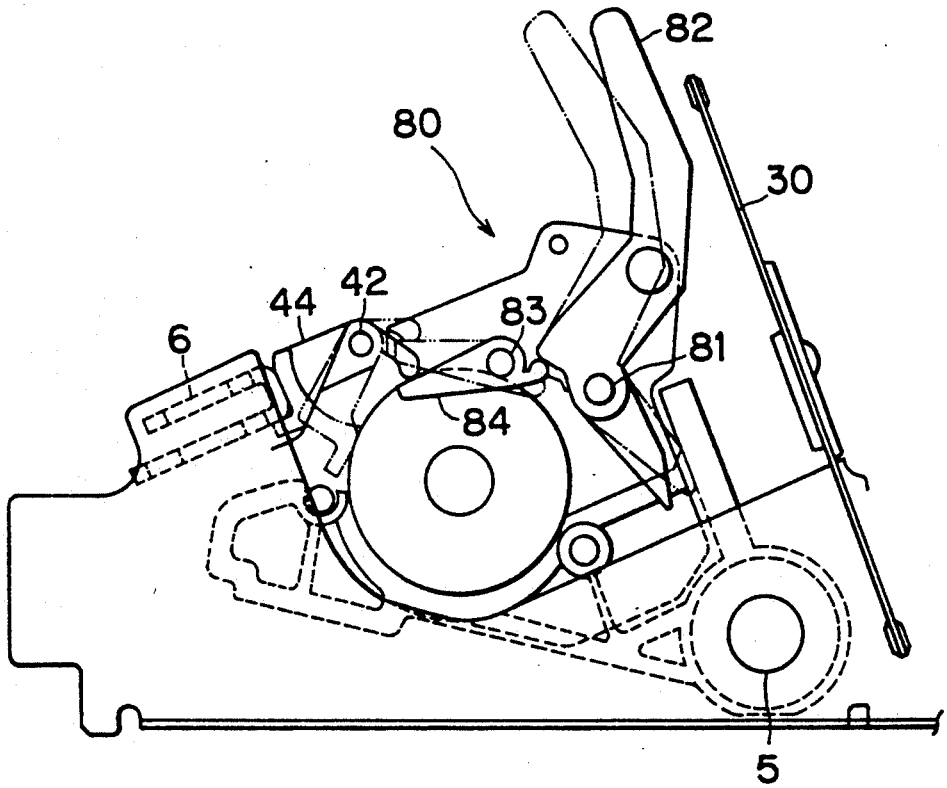
FIG. 11 is a side elevational view of the internal mechanism, the view being illustrative of a release mechanism.

A release mechanism 80 for moving the carriage 7 to a release position for replacing the daisy wheel 30 will briefly be described below with reference to FIGS. 10 and 11. A release lever 82 is angularly movably supported on the main frames 8 by a pin 81. The release lever 82 has a front end held against, from above, a rear end portion of a joint member 84 that is angularly movably supported on the main frames 8 by a pin 83. The joint member 84 has a front end held against, from below, a rear end portion of the abutment member 44. When the release lever 82 is turned from the printing position indicated by the solid lines in FIG. 11, to the release position indicated by the two-dot-and-dash lines, the joint member 84 is turned clockwise, turning the abutment member 44 counterclockwise out of engagement with the guide member 6. The carriage 7 is now turned into the release position about the guide shaft 6.

While the invention has been described with reference to specific embodiment thereof, it would be apparent to those skilled in the art that various changes and modifications may be made therein without departing from the spirit and scope of the invention. For example, the adjustable fixing mechanism 40 is not limited to the illustrated embodiment, but may be of any arrangement such that it can fix the adjusting plates 41 to the main frames 8 while allowing the adjusting plates 41 to be positionally adjusted in the direction along the main frames 8.

What is claimed is:

1. A printer comprising:

a platen a guide member disposed in front of and parallel to the platen;

a guide shaft disposed below the platen and the guide member and extending parallel to the platen;

a carriage body angularly movably supported on the guide shaft and laterally movably guided by the guide shaft and the guide member along the platen, the carriage body carrying a type wheel and a print hammer; and a device for adjusting a moving stroke of the print hammer comprising:

abutment means having one end and another end slidably engageable with the guide member for guiding lateral movement of the carriage body along the guide member;

at least one adjusting plate supported on the carriage body, the adjusting plate having one end pivotally connected to the one end of the abutment member; and adjustable fixing means connected between the adjusting plate and the carriage body, said adjustable fixing means being arranged for position-adjustably fixing the adjusting plate relative to the carriage body in a frontward/rearward direction of the printer by turning the carriage body about the guide shaft, thereby adjusting said moving stroke of the print hammer up to the platen.

2. The printer as claimed in claim 1, wherein the carriage body comprises a pair of main frames extending in the frontward/rearward direction, each of the main frames being formed with an oblong hole extending in the frontward/rearward direction, and wherein the one end of the adjusting plate is provided with a support shaft extending through the oblong hole, the one end of the abutment means being rotatably connected to the support shaft.

3. The printer as claimed in claim 2, wherein the adjusting plate has another end formed with an oblong hole extending in the frontward/rearward direction, and wherein the main frame is provided with a hole in alignment with the oblong hole of the adjusting plate, and wherein the adjustable fixing mechanism comprises a screw threadingly engageable with the hole of the main frame and the oblong hole of the adjusting plate, the adjusting plate being movable by a length of the oblong holes relative to the main frames, whereby the angular position of the main frame is controllable.

4. The printer as claimed in claim 3, wherein the adjusting plate has an intermediate portion formed with a notch, and wherein the main frame is formed with a mark, alignment between the notch and the mark providing a reference position of the print hammer.

5. The printer as claimed in claim 4, further comprising a print hammer moving mechanism which comprises;

a drive motor;

a print hammer cam operatively connected to the drive motor and having a whirl shape;

a cam follower in rolling contact with the print hammer cam; and a lever member pivotally supported on the main frame and connected between the print hammer and the cam follower, rotation of the print hammer cam providing a vertical motion of the cam follower which in turn provides movement of the print hammer toward and away from the platen.

6. The printer as claimed in claim 5, wherein the print hammer cam has a whirl shape containing a greatly increasing radius portion and a moderately increasing radius portion contiguous therewith, the greatly increasing radius portion providing high speed of the print hammer at a spaced distant zone thereof relative to the platen, and the moderately increasing radius portion providing reduced speed of the print hammer at a closed distant zone thereof relative to the platen.

7. A printer comprising:

a platen;

a guide member disposed in front of and parallel to the platen, the guide member having a rear end portion;

a guide shaft disposed below the platen and the guide member and behind the guide member and extending in parallel to the platen;

a carriage body angularly movably supported on the guide shaft and guided by the guide shaft and the guide member, the carriage body being also laterally movable along the platen and carrying a type wheel and a print hammer, the carriage body having an upper end portion;

an abutment member disposed on the upper end portion of the carriage body, the abutment member having a front end portion provided with an engaging portion slidably engageable with the rear end portion of the guide member for guiding the carriage body by the guide member;

a pair of adjusting plates mounted on the carriage body and provided with support shafts extending parallel to the guide member, the abutment member having a rear end portion pivotally supported on the adjusting plates by the support shaft; and an adjustable fixing mechanism by which the adjusting plates are positionally adjustably fixed to the carriage body for positional adjustment in a direction perpendicular to the platen, the adjusting plates and the abutment member being positionally adjusted with respect to the carriage body in the direction perpendicular to the platen by the adjustable fixing mechanism, for thereby turning the carriage body about the guide shaft to adjust the stroke of the print hammer up to the platen.

* * * * *